US006272810B1

(12) United States Patent
Ingram et al.

(10) Patent No.: US 6,272,810 B1
(45) Date of Patent: Aug. 14, 2001

(54) METHOD AND SYSTEM FOR PROVIDING FOUNDATION AND PERIMETER STEM WALLS FOR MOBILE HOMES

(76) Inventors: Jack L. Ingram, 201 E. Garfield, Enterprise, OR (US) 97828; Gene B. Williamson, 606 N. College, Joseph, OR (US) 97846

( * ) Notice: Subject to any disclaimer, the term of this patent is extended or adjusted under 35 U.S.C. 154(b) by 0 days.

(21) Appl. No.: 09/317,585

(22) Filed: May 24, 1999

(51) Int. Cl.[7] ..... E04B 1/16; E04G 21/00

(52) U.S. Cl. ..... 52/742.14; 52/169.12; 52/293.3; 52/294; 52/741.13; 52/DIG. 3; 249/34

(58) Field of Search ..... 52/292, 293.1, 52/294, 293.2, 299, 143, 741.11, 741.13, 741.14, 741.15, 742.1, 742.14, 745.1, 745.16, DIG. 3, DIG. 11, 169.12, 293.3, 742.13; 405/229; 249/34

(56) References Cited

U.S. PATENT DOCUMENTS

| | | | | |
|---|---|---|---|---|
| 3,685,241 | * | 8/1972 | Cooper | 52/270 |
| 3,708,931 | * | 1/1973 | Button | 52/169 |
| 3,820,295 | * | 6/1974 | Folley | 52/270 |
| 3,826,052 | * | 7/1974 | Tenorio | 52/293 |
| 4,010,584 | * | 3/1977 | Barnes, Jr. | 52/299 |
| 4,222,208 | * | 9/1980 | Ferver | 52/169.5 |
| 4,263,762 | * | 4/1981 | Reed | 52/293 |
| 4,464,873 | * | 8/1984 | Geiger | 52/293 |
| 4,481,743 | * | 11/1984 | Jellen | 52/64 |
| 4,501,098 | * | 2/1985 | Gregory | 52/79.1 |
| 4,597,925 | * | 7/1986 | Loggy | 264/32 |
| 4,738,061 | * | 4/1988 | Herndon | 52/126.6 |
| 4,976,087 | * | 12/1990 | Pizzino | 52/742 |
| 5,882,540 | * | 3/1999 | Farrington | 249/34 |
| 5,924,251 | * | 7/1999 | Jalla | 52/293.1 |

* cited by examiner

*Primary Examiner*—Yvonne M. Horton
(74) *Attorney, Agent, or Firm*—Olson and Olson

(57) ABSTRACT

A method and system for providing the foundation pad and stem wall structure for mobile homes includes the steps of excavating a building site to form a substantially level building area; erecting simple concrete formwork to define and contain the pouring of a concrete slab foundation pad; positioning and leveling a plurality of stem wall support blocks at predetermined positions about and spaced inwardly of the periphery of the concrete formwork, the support blocks having an upper surface height which is less than the height of the formwork and hence the thickness of the future concrete slab foundation pad; placing precast concrete stem wall sections on the level support blocks to form an upright perimeter wall; and pouring the concrete slab foundation pad defined by the concrete formwork to embed the support blocks and bottom edge portion of the precast stem walls in the foundation pad thereby positively and rigidly fixing the stem wall and foundation pad together when the poured concrete cures.

5 Claims, 4 Drawing Sheets

18
20
26
24'
26

E
10
16
10A
10A
10A
10A
16
16
10
12
E 14
10A
10A
16
10
20
20'
26
24''
26

METHOD AND SYSTEM FOR PROVIDING FOUNDATION AND PERIMETER STEM WALLS FOR MOBILE HOMES

BACKGROUND OF THE INVENTION

This invention relates to the foundation and stem wall arrangement involved in the placement and setup of mobile homes and the like, and more particularly to a novel, simplified foundation and stem wall method and system which avoids a substantial portion of the labor-intensive construction aspects and time involved in the heretofore conventional site preparation preliminary to placement and setup of a mobile home.

As is well known in the art, mobile homes are factory-manufactured homes typically comprising two or more individual units which are each built on a trailable frame that allows for their ground transport from the factory to a desired homesite location where the individual units are set in place and connected together into their completed, finished, home. Since each unit of these homes is built on its own supporting frame, the mobile home does not require the same type of load-bearing foundation wall and footing construction that is required in conventional site-built homes which most people are readily familiar with. Nonetheless, it has been conventional in the art to provide peripheral stem walls for mobile homes using substantially the same construction method and techniques used for site-built homes simply for the lack of any other better or more cost and labor-effective alternative to the standard practice.

In the normal site preparation practice, a desired building site would be plotted and excavated as required for the construction of perimeter concrete footing forms to be constructed and foundation wall footings poured. Conventional concrete wall forms are then erected on the footings and the concrete walls poured; the concrete forms later being removed and the outer periphery being backfilled to specified grade. A concrete foundation slab is then poured within the excavated inner confines of the concrete perimeter wall, the slab being arranged for receiving and providing a supporting foundation base pad for the setup of the mobile home units as is standard practice. With the mobile home setup completed, the aforementioned concrete foundation and pad form an enclosing crawl space beneath the mobile home, while the outside periphery of the mobile home, once backfilled and finished to proper grade level, resembles, for all intent and purposes, the appearance of a site-built home.

From the foregoing however, it is readily apparent that the preparation and construction of the foundation pad and concrete skirting encompasses an unduly substantial amount of concrete work not unlike that of a conventional site-built house even though the concrete wall and footing structure is not a load-bearing supporting element for a mobile home structure. Accordingly, a need exists in the marketplace for a more time and cost-efficient method and system for providing the concrete foundation and skirting for mobile homes which are to be set at great level to simulate the appearance of a typical site-built home construction.

SUMMARY OF THE INVENTION

In its basic concept this invention provides a novel and greatly simplified method and system for the site preparation and setup of the foundation pad and associated stem walls for mobile homes, the method and system including the provision of pre-manufactured stem wall sections arranged for delivery and rapid placement and assembly prior to a single concrete pour of the underlying concrete foundation pad.

It is by virtue of the foregoing basic concept that the principal objective of this invention is achieved; namely, the provision of a method and system which greatly simplifies the site preparation and on-site concrete work and labor and significantly reduces the time and personnel required in the preparation of a site preliminary to delivery and setup of a mobile home.

Another object of this invention is the provision of a method and system of the class described which accommodates any desired number and arrangement of mobile home units in a home construction.

Another object of this invention is the provision of a method and system of the class described which eliminates substantially all of the on-site concrete form construction labor, time and materials required in the prior art method of foundation and stem wall construction.

A further object of this invention is the provision of a method and system of the class described which provides for the pre-manufacturing and stocking of pre-cast stem wall sections which allow for rapid and simple truck delivery to building sites for setup, as well as providing for simplified yet enhanced control over the stem wall construction aspects in meeting the various requirements and specifications called for by the home manufacturer in each given installation situation.

A still further object of this invention is the provision of a method and system of the class described which reduces the overall time, labor and cost involved in the foundation and stem wall construction for mobile homes for the benefit of the industry and the individual homeowner.

The foregoing and other objects and advantages of the method and system of this invention will appear from the following detailed description, taken in connection with the accompanying drawings of a preferred embodiment.

DETAILED DESCRIPTION OF THE PREFERRED EMBODIMENT

At the outset it is to be understood that the present system does not relate to the mobile home constructions and courts and parks of yesteryear where mobile homes were simply truck transported and positioned on a setup site; placed on elevated supports; assembled into finished condition as required; had their transport wheel carriages removed and lastly provided with a simple aluminum or plastic peripheral skirting depending to the ground as was the typical practice many years ago. Indeed, the mobile home of today's art are designed to substantially replicate a conventional site-built home with conventional, grade level entry and a foundation-duplicating appearance, both for aesthetics as well as energy conservation purposes. Today's art provides mobile home constructions and indeed entire neighborhoods of mobile homes which are virtually indistinguishable in appearance from homes and neighborhoods built in conventional, custom site-built manner. The overall cost savings of partially factory-manufactured housing over the traditional site-built housing serves, however, to illustrate the advantages and cost efficiency of pre-manufacturing elements of constructions where possible as in the method and system of the present invention as will become clear herein.

In this connection, mobile home building sites of today's art are prepared in a substantially traditional manner not unlike that of conventional site-built homes in that an area is excavated to a specified depth, the excavating also providing for the forming and provision of concrete foundation wall footings and upstanding peripheral stem walls in substantially the same manner as a peripheral, load-supporting foundation footing and walls of a site-built home is constructed preliminary to framing, despite the fact that mobile homes do not require the upstanding peripheral foundation walls for any of their actual load-bearing support.

With the foregoing in mind, the method and system of this invention provides a substantially identical mobile home foundation and stem wall end-product, while at the same time eliminating nearly all of the heretofore traditional on-site, custom concrete form construction steps, time and labor, while also significantly reducing the start-to-finish excavation and construction time for site preparation preliminary to delivery of the mobile home units to a fraction of that of the traditional foundation and stem wall preparation, as will become apparent.

Figures 1, 2A, 2B:
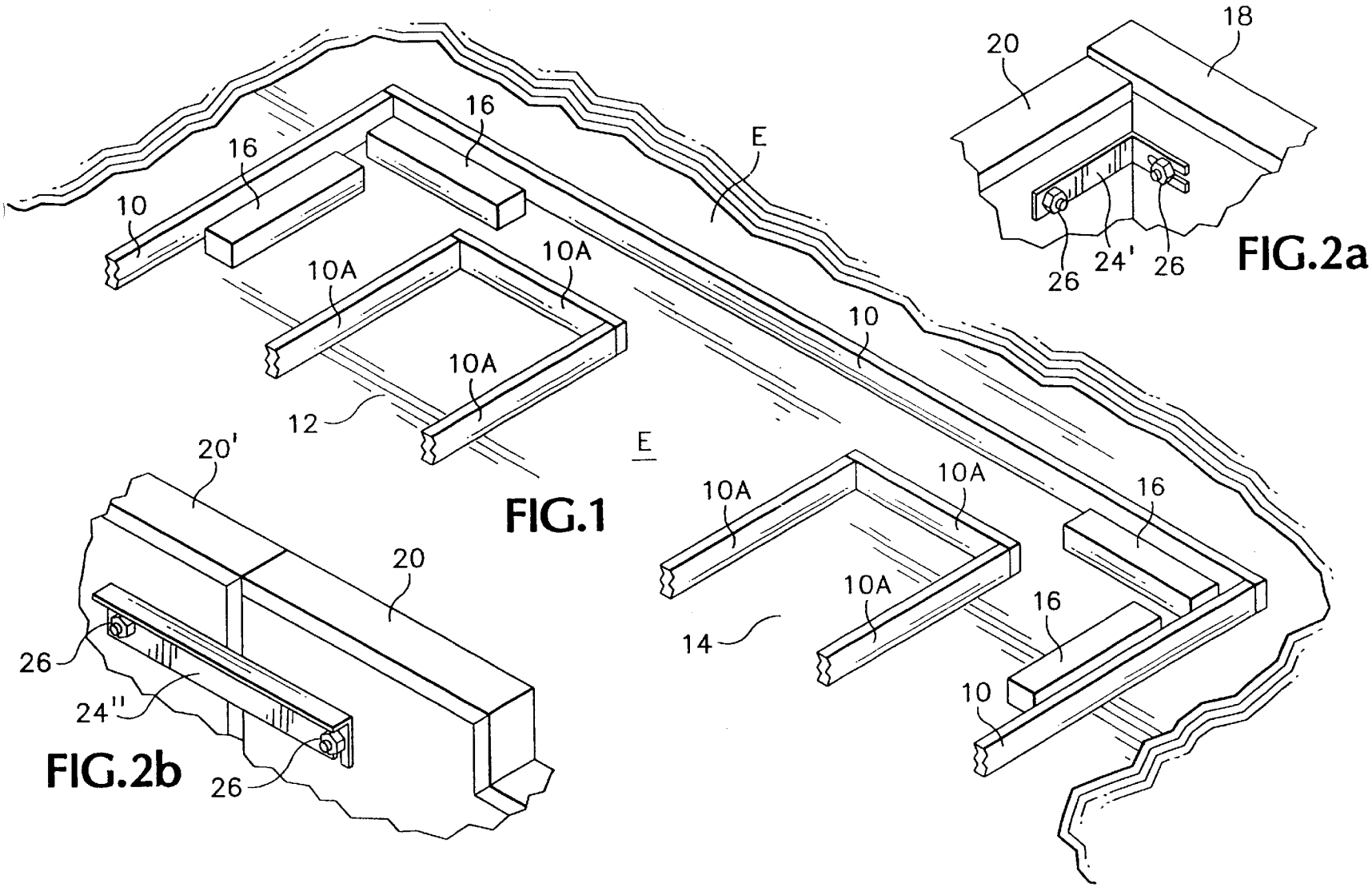
FIG. 1 is a fragmentary perspective view of an end portion of a typically rectangular-shaped, excavated building site showing a portion of a peripheral concrete form setup and wall-supporting block members set and leveled in the initial step of the method of this invention.
FIGS. 2*a* and 2*b* are fragmentary perspective views on an enlarged scale showing various stem wall anchoring arrangements provided to secure adjacent stem wall sections together once set and finally positioned on the block members.
Figure 3:
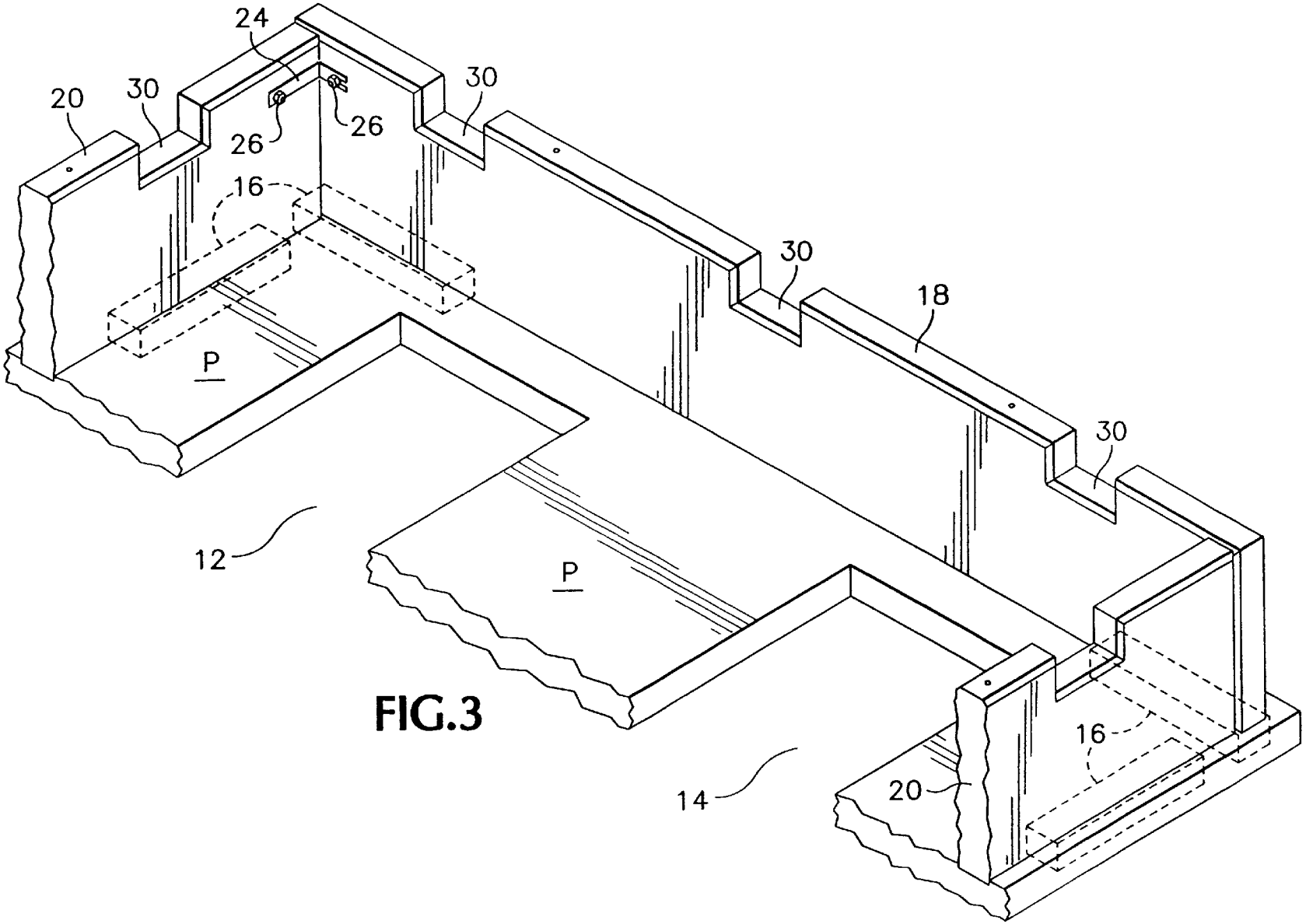
FIG. 3 is a fragmentary perspective view similar to FIGS. 1 and 2 of the drawings showing the foundation and stem wall system of this invention in a substantially finished, complete condition subsequent to the step of pouring the concrete foundation pad and removing the simple, peripheral concrete forms.
Figure 5:
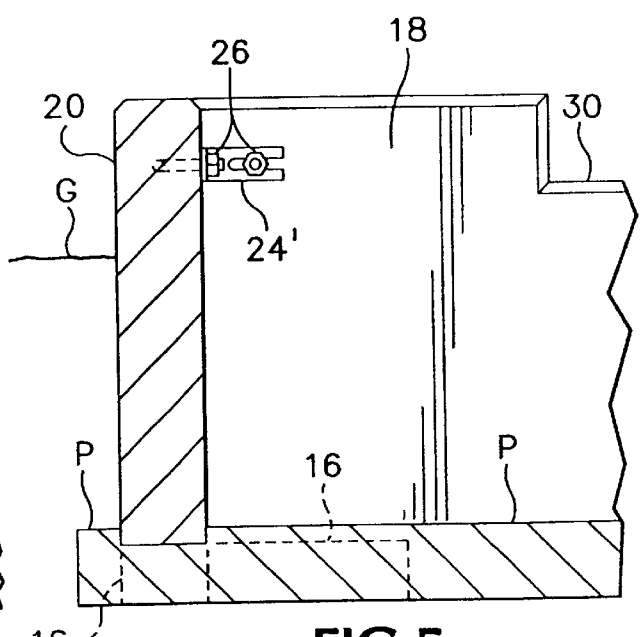
FIG. 5 is a fragmentary sectional view similar to FIG. 4 but showing the concrete form and wall section lifting hooks removed and the excavated area outside the stem wall backfilled to finish grade.
Figure 4:
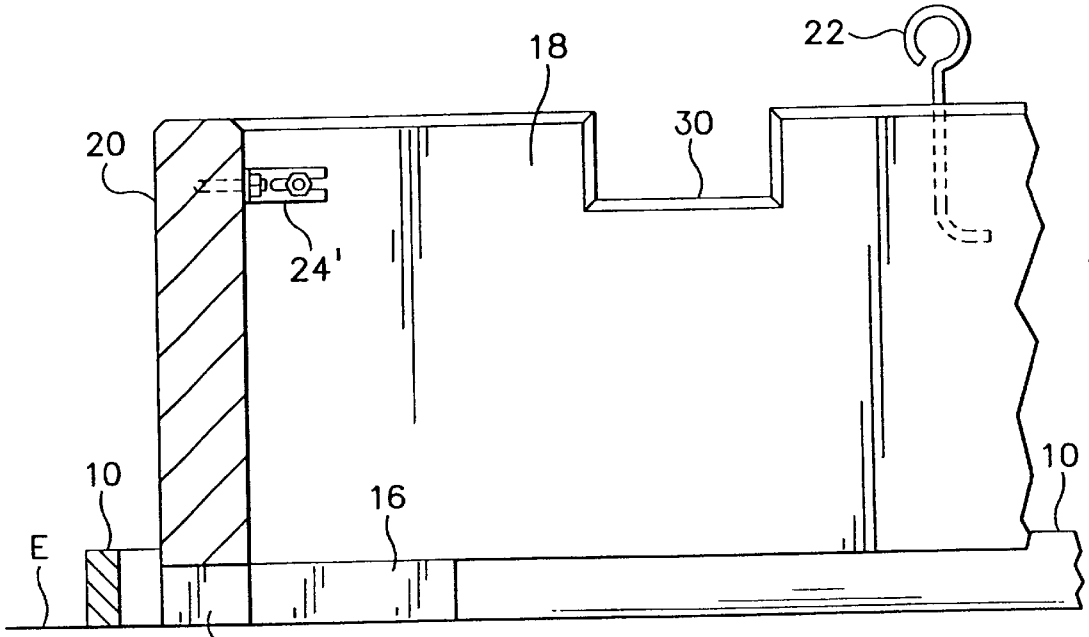
FIG. 4 is a fragmentary sectional view, on an enlarged scale, of the positioned stem wall block members and concrete-form of FIG. 2, taken along the line 4—4 in FIG. 2.

After selection of a site upon which a mobile home will be set up, the site is surveyed, marked out and excavated to form a substantially level, base ground surface pad area at a depth of typically approximately 24 inches below the finish grade level, or as is dictated by particular land contour, etc. This excavated area typically extends 1 ft to 3 ft beyond the actual stem wall position that is called for in the manufacturer's specifications for the particular home being placed. Once the actual wall location lines are identified and plotted, simple outer peripheral concrete form boards 10, typically of 2×6 stock, are constructed to define the outer peripheral edge of a future concrete slab pour to be explained in detail in connection with FIG. 3. The form boards are typically positioned approximately 3 inches to 4 inches outside of the specified stem wall location for reasons which will become apparent. The concrete form boards are preferably erected to define and provide a substantially leveled top edge about its periphery so that the concrete slab that is poured later will be substantially flat and level. As also illustrated in FIG. 1, additional, central concrete form boards 10*a* may, if desired, also be provided to form open cavities 12, 14 to provide areas which will be isolated from the concrete slab pour to save on concrete material and costs where the underlying slab is not needed for the support of the mobile home unit. Provision of these open areas is also preferred in order to permit water drainage from the concrete crawl space beneath the home in the event that surface water or water from a plumbing breakage make its way into the area beneath the home. Absent these open cavities, transient water will tend to simply pool on the concrete slab and result in an undesirably damp and stagnent environment beneath the home, as is already known by those skilled in the mobile home industry.

Figure 2:
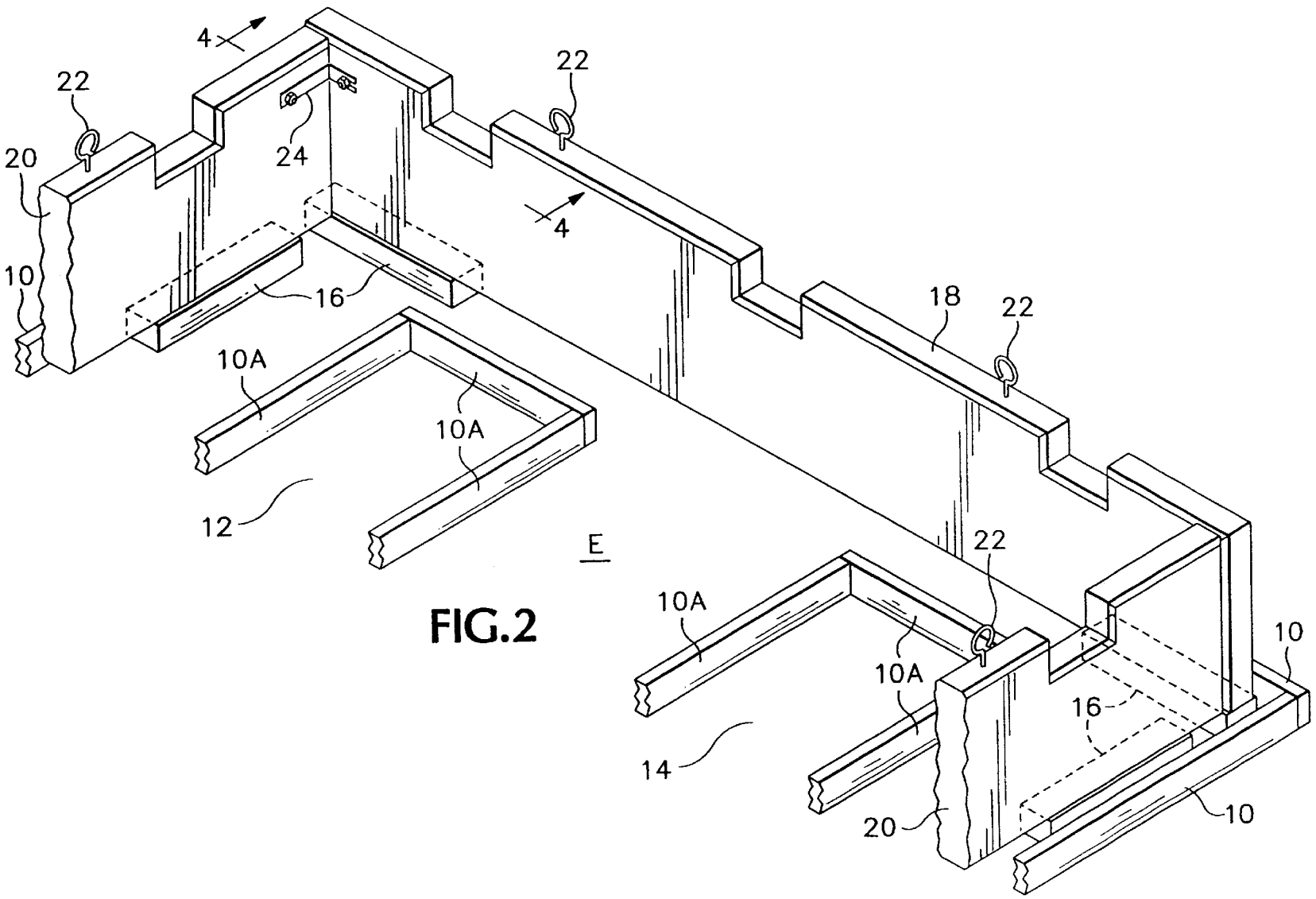
FIG. 2 is a fragmentary perspective view similar to FIG. 1 showing precast stem wall sections of this invention set in place on the block members and fastened together to form a secure and structurally rigid enclosure, in a subsequent step in the method and system of this invention.

With the outer peripheral boundary of the future concrete slab thus established by the peripheral outer form boards 10, a plurality of concrete support blocks 16 are positioned at predetermined, spaced apart points about the periphery defined by the form boards 10 and spaced approximately 3 to 4 inches inwardly of the form boards and centered closely on the precise construction lines called for in the home manufacturer's specifications for the final position of the future peripheral stem walls. In the particular embodiment illustrated herein, support blocks 16 have been positioned at the opposite corners of one longitudinal end of the building site for receiving and supporting the ends of a single, full length end wall section 18 and the ends of a pair of side stem wall sections 20 as shown in FIG. 2.

Still with reference to the temporary support blocks 16, the support blocks are placed on the ground and carefully leveled between them about the entire periphery of the building area to assure that the stem wall sections that will later be placed thereonto will be as close to level and plumb as reasonably possible. The support blocks are preferably configured with a ground engaging surface area that is selected according to the particular soil bearing capacity of the underlying earth at the particular building site. In the embodiment illustrated, 4 inch thick support blocks 16 are provided in 6 inch widths to support placement of a typical 6 inch thick stem wall section, and hence the length of the support blocks 16 will be determined by the particular soil qualities encountered at the building site. As an example, while a 3 ft. 9 inch long support block may be required to support a particular wall section on earth having a soil bearing capacity of 1,000 lbs per sq. ft., a support block of only 1 ft. 3 inches would be adequate at building sites with a 3,000 lb per sq. ft. soil bearing capacity.

Further with regard to the particular configuration of the support block member 16, it is important to understand that it is an essential requirement of the method and system of this invention that the support block members, irrespective of their bottom surface configuration, etc., must be less in thickness (height of top surface above ground) that is less than the height of the form boards and hence the thickness of the eventual concrete slab foundation pad yet to be poured. In the embodiment illustrated, the form boards have been described as comprising 2×6 stock which as is well understood in the art will provide a 5½–6 inch thick concrete slab. In this connection, the support blocks 16 of this embodiment are configured with a 4 inch thickness, resulting in a wall-supporting top surface that is approximately 1½–2 inches below the top surface of the future slab.

Also, as will be readily apparent, additional support blocks (not shown) will be positioned as needed about the periphery of the building site to accommodate placement of multiple stem wall sections in end-to-end relation for long walls as well as for other inside and outside corners, etc. that may be called for in the particular home layout.

Having referenced the stem wall sections 18, 20 of the present invention, attention is again directed to FIG. 2 of the drawings which illustrates that, once the supporting blocks have been positioned and leveled, the method and system of this invention provides for the delivery of a plurality of precast stem wall sections to the building site from a manufacturing facility. For continuity of disclosure herein, detailed description of the stem wall sections themselves will be deferred to a later point in the present specification.

As will be easily understood from FIG. 2, the premanufactured stem wall members for the particular job are delivered by truck to the building site and selectively off-loaded by the crane of the truck and maneuvered into position for gentle and accurate placement onto corresponding support blocks 16, the wall sections being easily guided into precise proper position by gentle hand manipulation by only one or two workers. Lifting rings 22 may be provided during manufacture of the wall section to facilitate its easy handling from manufacture to final placement at a building site. These lifting rings 22 will then simply be cut off and discarded once final installation has been made.

With all of the support blocks 16 having been previously carefully positioned and leveled about the perimeter of the building site, it is to be understood that the elongated wall sections placed thereon will be supported in a substantially level and plumb condition as successive adjacent wall sections are removed from the truck and manipulated carefully into their final positions. As illustrated in FIG. 2, once a second wall section is positioned adjacent to and abutting a previously set wall section, the two wall sections are preferably then fastened together with stem wall anchoring brackets 24 which secure the upper portions of the wall sections rigidly and positively together, as by bolts 26, in a structurally sound connection. FIG. 2*a* illustrates a corner bracket 24' arrangement for inside corners and FIG. 2*b* illustrates a straight anchor bracket 24" to fasten together two longitudinally extending wall sections in end-to-end condition. The foregoing installation process is repeated until the last stem wall section has been installed and secured in place and the entire periphery of the building site is finished.

With the entire perimeter stem wall of the building site thus very speedily erected, as will easily be recognized by those familiar in the conventional method, the concrete pad is then poured throughout the entire interior areas defined by the concrete form boards 10, 10*a* in the standard manner, assuring that the fluid concrete mixture completely fills the space around the support blocks and between the bottom edge of the stem walls and the underlying earth between the spaced apart support blocks 16 upon which the stem walls are resting. As previously mentioned, since the form boards 10, 10*a* are greater in height than is the height of the support blocks 16 (and hence the bottom edge of the precast stem wall supported thereon), the bottom portion of the peripheral stem wall and all of the support blocks 16 will be buried and rigidly fixed within the concrete slab foundation pad P when it sets and hardens.

Accordingly, it should be readily apparent that with the wall anchors 24 securing the upper portion of adjacent stem wall sections together and the lower portions of the stem walls secured together and to the foundation pad by virtue of the embedded nature of the bottom edge of the stem walls within the concrete foundation pad, a structurally sound, substantially unitary foundation pad and stem wall product results. The form boards 10, 10*a* are then removed for reuse at another building site.

Figure 6:
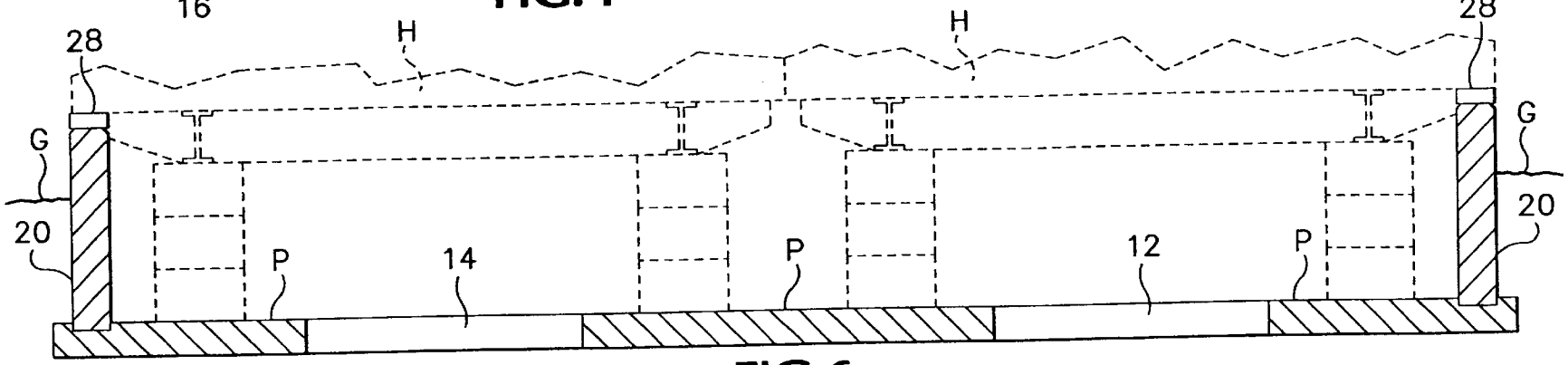
FIG. 6 is a fragmentary sectional view through the finished system after placement and setup of a two-unit mobile home (in broken lines) supported on the foundation pad, and the mobile home's relation to the underlying stem wall and finished grade level.

With a mobile home foundation thus erected, a sill plate 28, preferably of treated wood stock, is anchored along the top edge of the stem walls in conventional manner to provide an anchor sill for connection of the mobile home about its periphery, as indicated in FIG. 6. Vent screens (not shown) are installed in the vent openings 30 provided in the stem wall sections to permit ventilation of the crawl space area beneath the installed mobile home while preventing free access of rodents, etc., into the crawl space area. With the mud sills installed, the mobile home units are delivered and installed onto blocking in the standard manner, secured to the mud sill and finish-assembled. The excavated area outside the periphery of the stem walls is back filled to finish grade level G, ready for final landscaping.

As mentioned earlier, reference will now be made to the manufacture of the precast stem wall sections at a remote, dedicated fabrication facility. Since the production manufacture of precast concrete building elements and other articles is known, discussion need not be given herein to the particular manufacturing methods, etc. With regard however to the stem wall sections themselves, typically they will be formed, as indicated earlier, approximately six inches in thickness and approximately 31 inches in overall height, with conventional internal concrete reinforcements as dictated by local building codes pertaining to mobile home stem wall constructions. Typically, wall sections will be formed in various, certain predetermined lengths so that by installing various combinations of individual stem wall sections end-to-end at a building site, virtually every mobile home manufacturer's stem wall specification can be accommodated from a standard stock inventory. In the event that custom sizes may be required for unique installations, the production concrete forms in the art are readily adjustable for specialized lengths, as is known.

From the foregoing it will be apparent to those skilled in the art that various changes may be made in the steps of the method of this invention and in the size, shape, type number and arrangement of parts of the described system of this invention without departing from the spirit of this invention and the scope of the appended claims.

Having thus described the method and system of my invention, I claim:

1. A method of preparing building sites for installation of mobile homes and other structures, the method comprising:

a) excavating a building site to form a foundation base ground surface area disposed at a predetermined depth below original grade level, b) determining construction lines defining the location for the erection of an upstanding peripheral stem wall in accordance with specifications of a particular structure to be installed, and erecting outer peripheral concrete slab foundation pad formboards a predetermined spaced distance outwardly of and about said construction lines, said peripheral concrete form boards selected and erected to provide and contain the pouring of a substantially level, concrete slab foundation pad having a predetermined, first thickness, c) positioning a plurality of spaced apart, stem wall support blocks on said ground surface area along said construction lines spaced inwardly of said erected peripheral concrete formboards, and leveling the support blocks around the stem wall construction line as needed, said support blocks being selected with a thickness that provides an upper stem wall-supporting surface that is less in height from the ground surface than is said predetermined, first thickness of the concrete slab foundation pad to be poured within said erected, peripheral concrete slab formboards, d) pre-manufacturing a plurality of precast stem wall sections of predetermined dimensions at a remote site, delivering them to an installation site and setting the stem wall sections in upstanding condition on the positioned and leveled, spaced apart support blocks arranged along the construction lines, e) pouring concrete on the base ground surface area within said outer peripheral form boards to provide a concrete slab foundation pad having said predetermined, first thickness, assuring that the concrete fills the open areas around and under the stem wall sections and the spaced apart support blocks and assuring that a bottom portion of the erected, peripheral stem wall is embedded a predetermined distance within the finished concrete slab foundation pad.

2. The method of claim 1 wherein the finished concrete slab foundation pad extends at least 3 inches outwardly of and about the outside surface of the erected, upright stem wall embedded therein.

3. The method of claim 1 including the step, prior to pouring the concrete slab foundation pad, of fastening the upper portions of adjacent stem wall sections together with anchor members to increase the strength, rigidity and structural integrity of the assembled stem wall above its embedded securement within the finished concrete slab foundation pad.

4. The method of claim 1 including the step of providing and attaching sill plates to the top edge of the erected stem wall.

5. The method of claim 1 including the final step, after the concrete slab foundation pad has set and hardened, of backfilling the excavated area outside the perimeter of the stem wall to a desired finish grade level.

* * * * *